US005913731A

United States Patent [19]

Westerman

[11] Patent Number: 5,913,731

[45] Date of Patent: Jun. 22, 1999

[54] GOLF PUTTER

[76] Inventor: Clive B. Westerman, Crans-Forest, 3963 Cran-sur-Sierre, Switzerland

[21] Appl. No.: 08/967,717

[22] Filed: Nov. 10, 1997

[51] Int. Cl.[6] ..... A63B 69/36; A63B 53/04

[52] U.S. Cl. ..... 473/251; 473/313; 473/340; 473/349; 473/252

[58] Field of Search ..... 473/219, 251, 473/252, 253, 254, 255, 256, 282, 291, 293, 305, 313, 324, 340, 341, 328, 349; D21/733–746

[56] References Cited

U.S. PATENT DOCUMENTS

| | | |
|---|---|---|
| D. 229,204 | 11/1973 | Romero . |
| 1,703,199 | 2/1929 | McClure . |
| 3,064,975 | 11/1962 | Smith . |
| 3,770,279 | 11/1973 | Phinny . |
| 4,655,459 | 4/1987 | Antonious . |
| 4,867,457 | 9/1989 | Lowe . |
| 4,871,174 | 10/1989 | Kobayashi . |
| 5,286,027 | 2/1994 | Koumarianos . |
| 5,294,122 | 3/1994 | Longo . |
| 5,467,987 | 11/1995 | Perkins et al. . |
| 5,494,282 | 2/1996 | Pranio . |
| 5,527,035 | 6/1996 | Marshall . |
| 5,795,246 | 8/1998 | Hale . |

OTHER PUBLICATIONS

Edwin Watts Golf Shops, Winter 1997 Catalog, published by Edwin Watts Golf Shop and mailed to its customers on or about Nov. 15, 1997, per Lincoln Cox, Vice President of Marketing, Edwin Watts Golf Shops.

*Primary Examiner*—Sebastiano Passaniti

*Attorney, Agent, or Firm*—Allen, Dyer, Doppelt, Milbrath & Gilchrist, P.A.

[57] ABSTRACT

A golf putter provides for uniform contact with a golf ball during the putting stroke and a putter head having uniform mass distributed across the ball striking putter face for an enhanced feel and accuracy in the putting stroke. The putter includes a putter head having a mallet portion carrying a substantial mass of the putter head uniformly distributed between heel and toe portions of the mallet portion and a blade portion carried in a suspended relation by the mallet portion. The blade portion has a bottom surface suspended above the bottom surface of the mallet portion for reducing unwanted scuffing of the putting surface during the striking of the golf ball, and includes a front face for striking the ball. A shaft extends upwardly from a heel of the mallet portion and includes a double bend spaced from the mallet portion for positioning a shaft handle above the blade portion and providing face balancing to the putter. The mass of the mallet portion is sufficient for reducing torque on the shaft during the striking of the golf ball and provides a desirable feel for the golfer during the putting stroke. To enhance alignment of the blade front face, the mallet portion includes a smoothly contoured channel carried within a top surface of the mallet portion which forms opposing parallel side wall edges transversely spaced by the diameter of the golf ball for aligning the golf ball within imaginary lines extending forward from the opposing side wall edges through the front face.

47 Claims, 5 Drawing Sheets

GOLF PUTTER

FIELD OF THE INVENTION

The invention relates generally to golf clubs, and in particular to a golf putter.

BACKGROUND OF THE INVENTION

It is well known that becoming a better golfer includes a requirement of reducing the number of putts taken on the green. Much has been written and a variety of putters produced to help the golfer obtain that perfect feel for the golfing swing and especially the putting stroke. The golfer seeks having that confident feel and striking the ball consistently with the goal of reducing the number of putts taken during a round of golf Golfers are taught that the putting stroke should be smooth, rhythmic, and fluid. The face of the putter should be square to the intended line to the target when the putter strikes the ball. The ball is to be struck solidly, making contact with the putter head face between the center of gravity of the putter head and the back of the ball. While constrained by the USGA Rules of Golf a variety of golf putters, including blade styled, mallet head, and flanged head, have been designed, typically looking to provide that improved feel and help a golfer avoid well known problems with the putting stroke. Divergent, independent attempts have been described and are well known in the art of putter design for achieving a desirable feel when executing the putting stroke. Blade style putters, for example, provide the golfer with a feel for the ball contacting the putter head, as in an inelastic reaction where two bodies having approximately the same mass collide with each receiving or "feeling" a reaction to the collision. Mallet styled putters, on the other hand, provide substantial mass for striking the golf ball and provide the golfer with a desirable "pendulum" swing. To complete the analogy, the mallet styled putter provides somewhat of an elastic reaction when contacting the ball. Because of its relative large mass compared to the ball, little if any feeling is experience by the putter head and thus little ,if any, feeling for the golfer.

By way of example, U.S. Pat. No. 3,064,975 to Smith discloses a golf club putter having a flat striking blade styled head that is elevated above a non-scuff shoe wherein the shoe holds the blade in an elevated position so that the bottom of the blade is spaced above the bottom of the shoe. The shaft is rearwardly spaced from the blade for providing a full view of the blade for the golfer. Further, the elevated blade provides an overspin to the ball when struck.

Putter head weight and weight distribution play an important factor in providing the feel, By way of further example, U.S. Pat. No. 4,655,459 to Antonious discloses mallet and flanged styled putter heads having cavities located within an upper surface of the putter head behind the ball striking face. The result being that the putter head weight distribution is below and behind the ball striking face and at the toe and heel of the club vertically above the center of percussion. U.S. Pat. No. 4,867,457 to Lowe discloses a golf putter head having its cavity extent through the head and behind the ball striking face portion of the head. Grooves are affixed along a top portion of the head for providing help in aligning of the putter head with the ball to be struck during use, another important factor in all golfing strokes. Further, the putter face is inclined for developing an overspin to the ball when struck, hence permitting the ball to roll along the surface very soon after being struck, avoiding a skipping motion that adversely affects the path of the ball.

Despite these divergent attempts, illustrated above by way of example, there remains a need to provide a putter which provides an easy alignment of the putter head with the golf ball and path through which the ball will travel, while providing a desirable feel when striking the ball, yet permitting a desirable pendulum like swing.

SUMMARY OF INVENTION

In view of the foregoing background, it is an object of the present invention to provide a putter having means for combined uniform contact with a golf ball and uniform mass distributing of a golf ball interface for striking the golf ball. It is further an object to provide a golf putter that provides the golfer with an improved feel when striking the ball and more particularly provides the golfer with reminders during the setting up of a putting for obtaining that feel. Such a feel is provided through a unique combination of face balance, blade stability, pleasing acoustic properties, and face suspension.

This and other objects, advantages, and features of the present invention are provided by a golf putter comprising a putter head and shaft. The putter head comprises a mallet portion carrying a substantial mass of the putter head uniformly distributed between heel and toe portions of the mallet portion. The substantial mass is uniformly distributed throughout the mallet portion and provides the putter head with a weight for enhancing contact with the golf ball during the putting strike as well as encouraging a desirable pendulum like swing by the golfer. The mallet portion has a top surface, an opposing arcuate bottom surface, an arcuate rear surface, and a flat front surface. A blade portion is carried by the mallet portion. The blade portion has elongate top and bottom surfaces, a flat front face for striking a golf ball, and a rear surface generally parallel to the flat front face. The rear surface is attached to the front surface of the mallet portion. The blade provides a ball striking face and a feel of the putter striking the golf ball for the golfer. The shaft is an elongate shaft extending upwardly from the putter head, preferably from the mallet portion and includes a handle portion and an opposing head portion. The opposing head portion has a double bend spaced from the mallet portion for positioning the handle portion of the elongate shaft above the blade portion. Alignment means for aligning the putter for striking the golf ball includes a channel carried within the top surface of the mallet portion and longitudinally extending from the rear surface toward the front surface of the mallet portion. The channel forms opposing parallel elongate side wall portions transversely spaced for aligning the golf ball within imaginary lines extending forward from the opposing side wall portions through the front face, the opposing elongate side wall portions of the channel being perpendicular to the front face. In a preferred embodiment, the channel includes a contoured surface transversely extending between the elongate side wall portions, the channel further having a bottom most surface portion of the contoured surface lying along a ball striking axis extending longitudinally through the putter head. By attaching the shaft to a heel portion of the mallet portion, a clear unobstructed view of the alignment means is provided for the golfer.

Further, the mallet portion includes an elongate cavity extending transversely across a central portion of the front surface of the mallet portion, wherein the central portion of the front surface of the mallet portion and a central portion of the rear surface of the blade portion form cavity walls. The elongate cavity extends from the mallet top surface to the mallet bottom surface. The cavity enhances the feel and effect of the golf ball striking the face of the blade portion. The bottom surface of the blade portion is offset from the bottom surface of the mallet portion. In a preferred embodiment, the mallet portion comprises a rounded bottom surface portion proximate the rear surface of the blade portion and the bottom surface of the blade portion suspended above the bottom surface of the mallet portion when the mallet portion rests on a playing surface for striking the golf ball. The suspended blade portion further has the effect of enhancing the feel and effect of the golf ball striking the face of the blade portion.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout.

Figure 1:
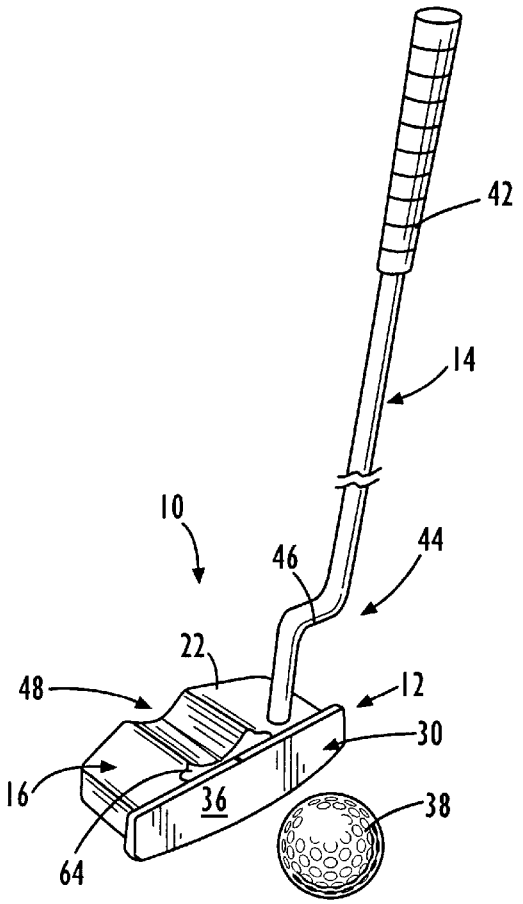
FIG. 1 is a fragmented top, front perspective view of a golf putter of the present invention.
Figure 2:
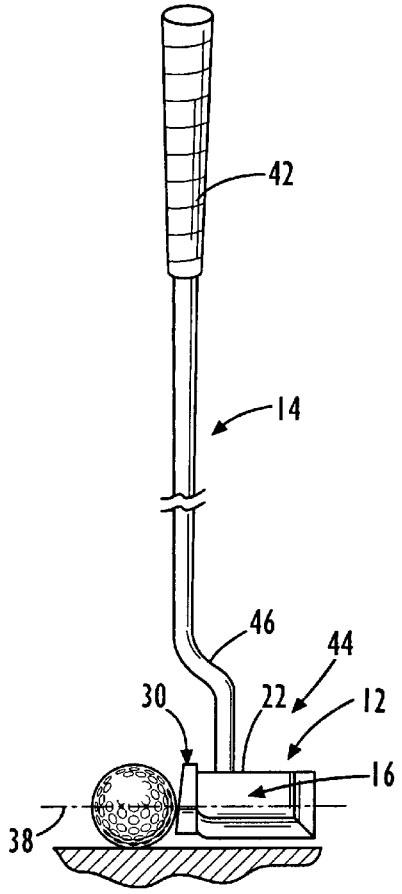
FIG. 2 is a fragmented side elevation view of the putter of FIG. 1.
Figure 3:
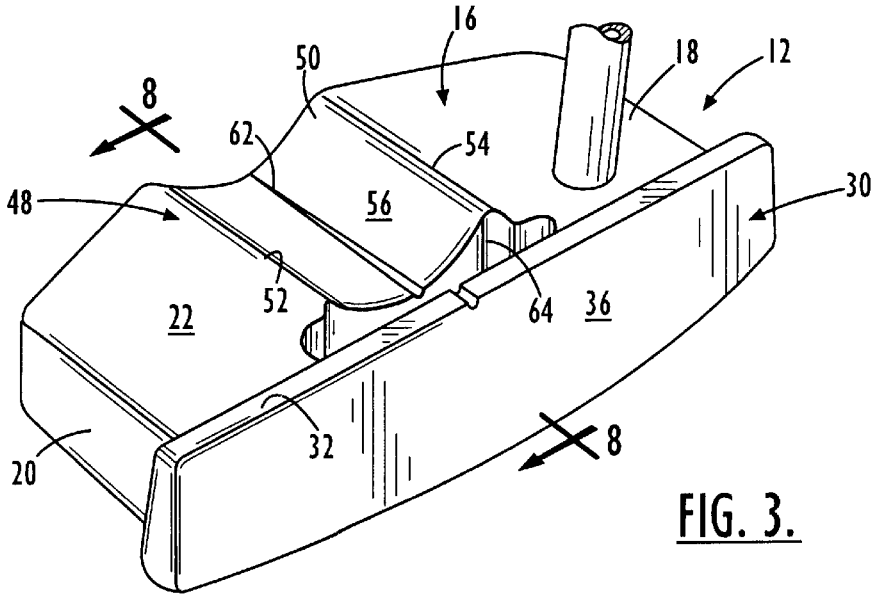
FIG. 3 is an enlarged top, front perspective view of a putter head of FIG. 1.
Figure 6A:
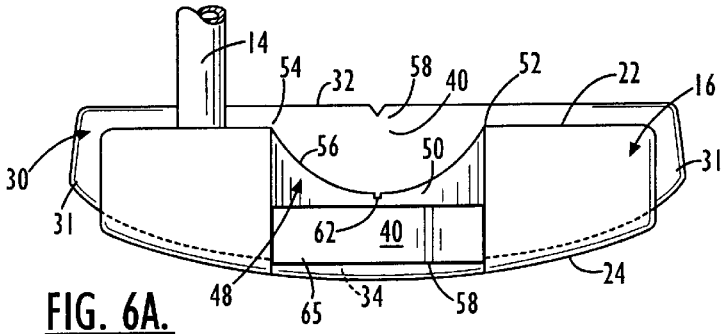
FIG. 6A is the rear elevation view of FIG. 6 illustrating an alternate cavity configuration for the putter head of FIG. 3.
Figure 4:
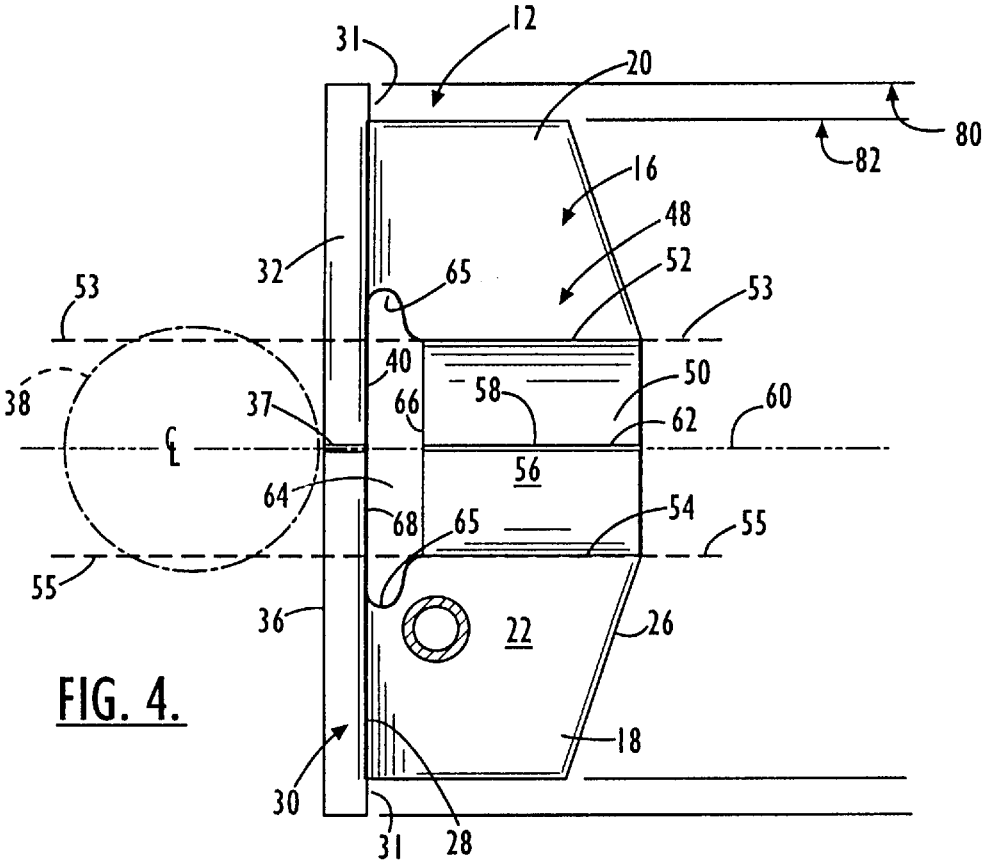
FIG. 4 is a top plan view of the putter head of FIG. 3.
Figure 5:
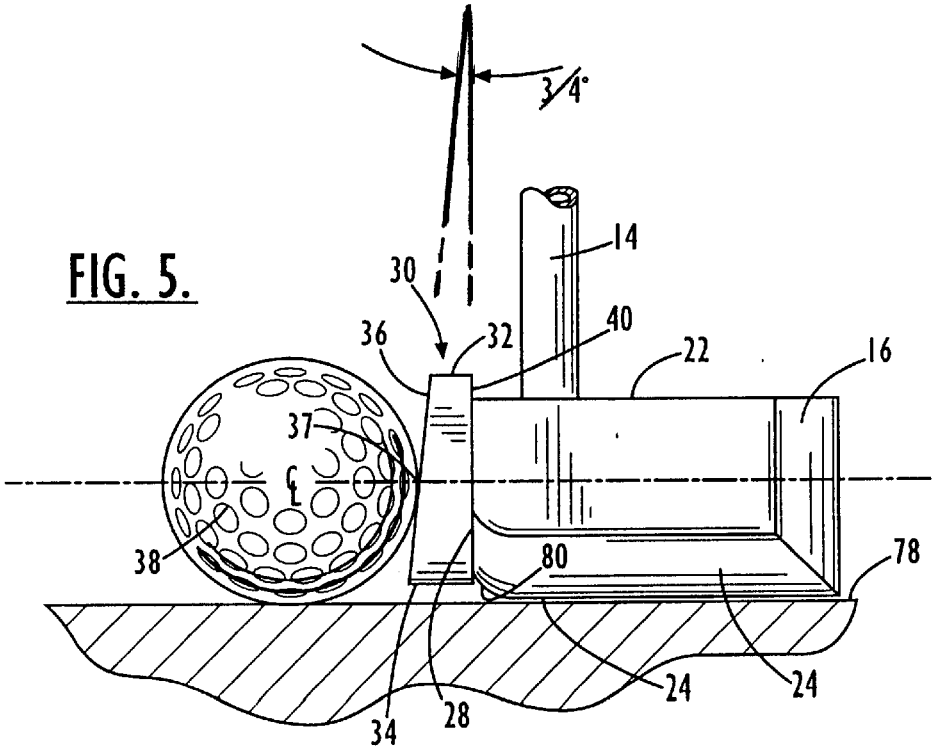
FIG. 5 is a side elevation view of the putter head of FIG. 3.
Figure 6:
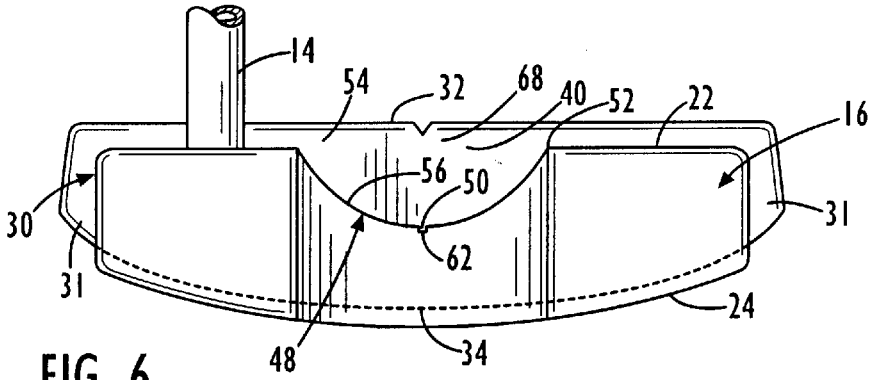
FIG. 6 is a rear elevation view of the putter head of FIG. 3.
Figure 7:
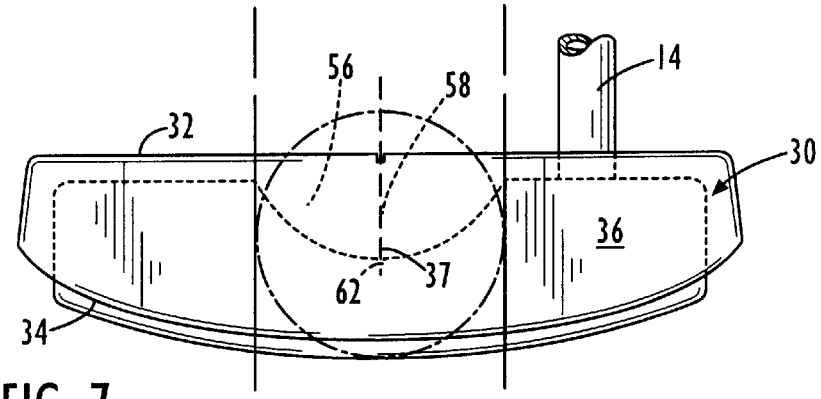
FIG. 7 is a front elevation view of the putter head of FIG. 3.

Referring initially to FIGS. 1 and 2, in a preferred embodiment of the present invention, a golf putter 10 comprises a putter head 12 and elongate shaft 14. As illustrated with reference to FIGS. 3 and 4, the putter head 12 comprises a mallet portion 16 carrying a substantial mass of the putter head, which mass is uniformly distributed between a heel portion 18 and a toe portion 20 of the mallet portion. As illustrated with reference to FIGS. 5 and 6, the mallet portion 16 is defined by a top surface 22, an opposing arcuate bottom surface 24, an arcuate rear surface 26, and a flat front surface 28. As illustrated again with reference to FIGS. 1–6, and FIG. 7, a blade portion 30 is carried in a face suspension configuration by the mallet portion 16. The blade portion 30 has elongate top and bottom surfaces 32, 34, a flat front face 36 for striking a golf ball 38, and a rear surface 40 generally parallel to the flat front face. The rear surface 40 of the blade portion 30 is attached to the front surface 28 of the mallet potion 16. In a preferred embodiment of the present invention, the blade portion 30 is integrally attached to and formed with the mallet portion 16, however in such a manner that the blade portion 30 is in a spaced relation with and suspended from the mallet portion 16. It is an object of the present invention to provide an improved feel for the golfer. Suspending the blade portion 30 from the large mass, or effectively the effect of the mass, carried by the mallet portion 16, contributes to an improved feel is achieved. Additional features add to the contribution of feel and will be addressed further herein.

As illustrated again with reference to FIGS. 1 and 2, in a preferred embodiment of the present invention, the putter 10 includes the elongate shaft 14 extending upwardly from the mallet portion 16, wherein the elongate shaft has a handle portion 42 and an opposing head portion 44. The opposing head portion 44 has a double bend 46 spaced from the top surface 22 of the mallet portion 16 for positioning the handle portion 42 of the elongate shaft 14 above the blade portion 30, and in particular for positioning the hands of the golfer in front of, or aligned with the club front face 36.

Figure 1A:
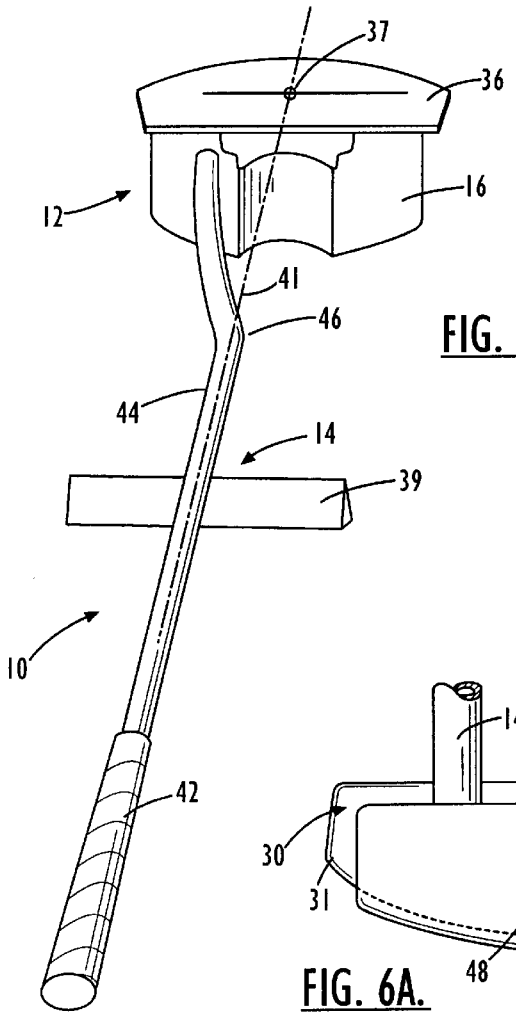
FIG. 1A is a perspective view of a putter of the present invention illustrating face balance.

With reference to FIG. 1A, a face balanced feature of the preferred embodiment is illustrated. In order to face balance the putter 10 such that the striking face 36 can provide a striking area 37 that is balanced with the shaft handle portion 42, the double bend 46 is made within the shaft 14. A, again with reference to FIG. IA, balance is illustrated when the putter 10 is in a balanced arrangement over a fulcrum 39, by way of example. As illustrated, a shaft axis 41 will extend through the handle portion 42 to the blade portion 30 proximate the striking area 37 of the striking face 36. With such balance achieved in the manner as herein described for a preferred embodiment, the striking face 36 will strike a ball 38, described earlier with reference to FIG. 1, at or close to the striking area 37, often referred to as "sweet spot," without delivering a twisting feel or feel of torque to the hands of the golfer holding the handle portion 42. As will be described later in further detail, extending the blade portion 30 beyond side walls of the mallet portion 16 aids in the face balancing.

As illustrated again with reference to FIGS. 1, 3–7, a preferred embodiment of the present invention includes alignment means 48 for aligning the putter 10 for striking the golf ball 38. The alignment means 48 include a channel 50 carried within the top surface 22 of the mallet portion 16. The channel 50 extends longitudinally from the rear surface 26 toward the front surface 36 of the mallet portion 16. As illustrated again with reference to FIGS. 4–6, the channel 50 forms opposing parallel elongate side wall portions or channel edges 52, 54 transversely spaced for aligning the golf ball 38 within imaginary lines 53, 55 extending forward from the opposing side wall portions 52, 54 through the front face 36. The opposing elongate side wall portions or channel edges 52, 54 for the case of the embodiment illustrated herein by way of example, are perpendicular to the front face 36. In the preferred embodiment herein described with reference again to FIGS. 6 and 7, the channel 50 includes a contoured surface 56 transversely extending between the elongate side wall portions 52, 54. The channel 50 includes a bottom most surface portion 58 of the contoured surface 56 lying along a ball striking axis 60 extending longitudinally through the putter head 12, as illustrated again with reference to FIGS. 4–7. In one preferred embodiment of the present invention, an elongate groove 62 extends longitudinally along the bottom most surface portion 58 of the channel 50 for forming a sight line along the ball striking axis 60 of the putter head 12 to further guide the golfer in aligning the putter 10. By positioning the elongate shaft 14 extending upwardly from the mallet portion 16 as earlier described, and as illustrated again with reference to FIGS. 1, 3 and 4, an un obstructed view of the channel 50, and thus alignment is facilitated for the golfer.

Figure 8A:
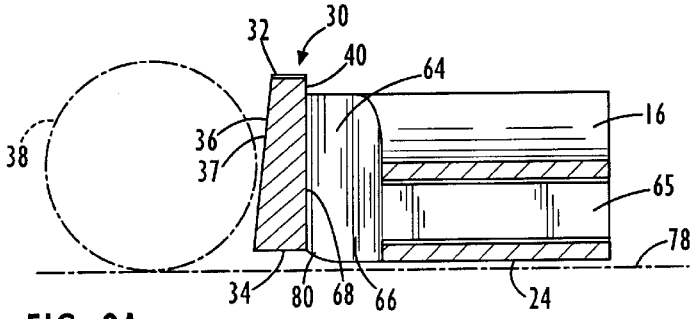
FIG. 8A is a cross-sectional view taken through lines 8—8 of FIG. 3 for the alternate embodiment illustrated with reference to FIG. 6A.

As described further again with reference to FIGS. 3 and 4, a preferred embodiment of the present invention includes an elongate cavity 64 within the mallet portion 16. The elongate cavity 64 extends transversely across a central portion 66 of the front surface 28 of the mallet portion 16. Alternate embodiments include the cavity 64 extending further into the mallet portion 16 without departing from the teachings of the present invention. The central portion 66 of the front surface 28 of the mallet portion 16 and a central portion 68 of the rear surface 40 of the blade portion 30 form cavity walls. The elongate cavity 64 extends through the mallet portion 16 from the mallet top surface 22 to the mallet bottom surface 24 and serves to further enhance the feel of the putter 10 by clearly having the blade portion 30 carried by the mallet portion 16 in a spaced and suspended relation thereto, as herein described. The cavity 64 performs as a resonance chamber for enhancing the feel and acoustic effect of the golf ball 38 striking the face 36 of the blade portion 30, thus providing the desired feel to the golfer. Various cavity shapes are provided to tailor the effects preferred by the variety of golfers. By way of further example, the cavity 64, in an alternate embodiment can extend into and through the mallet portion 16, thus having an extended cavity portion 65, extending partially into or through the mallet portion 16, as illustrated with reference to FIGS. 6A and 8A. In addition, the density of materials and thickness used for the blade portion are varied for providing various desirable effects. Such variations will also affect the distance the ball will travel on the green when struck by the putter. Preferred materials include brass, titanium, plastic and ceramic. Further, and by way of example, the mallet portion 16 may be made from one material, such as stainless steel, while the blade portion 30 is made from tungsten, brass or aluminum. It is expected that one skilled in the art will be guided by the present invention and provide various combinations of material for the blade and mallet portions. To further enhance such a feel and effect, the cavity 64 further includes opposing arcuate side wall portions 65 for extending exposure to the rear surface 40 of the blade portion 30 while maintaining a firm connection between the blade portion and the mallet portion 16.

Further, as illustrated again with reference to FIGS. 3,4,6 and 7, the blade portion 30 includes a transverse width dimension 80 greater than a transverse width dimension 82 of the front surface 28 of the mallet portion 16 for extending the front face 36 of the blade portion 30 transversely outward of the front surface of the mallet portion, enumerated as 31, further distinguishing the blade portion 30 from the mallet portion 16. As described earlier with reference to FIG. IA, varying the extended portion 31 aid in accomplishing the face balancing as well.

Figure 8:
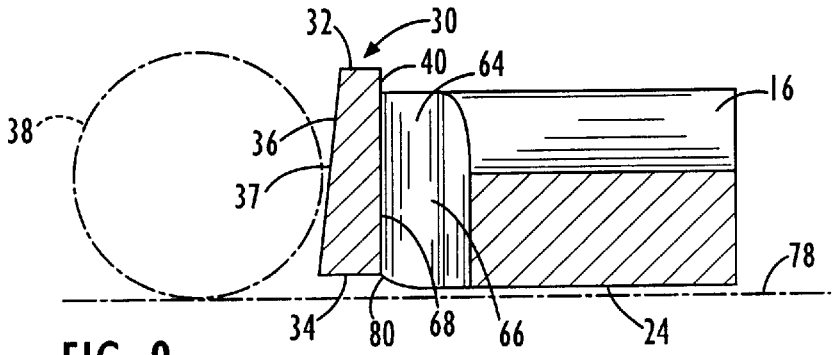
FIG. 8 is a cross-sectional view taken through lines 8—8 of FIG. 3.

As further illustrated and with reference again to FIGS. 5–8, a preferred embodiment includes the blade portion 30 suspended by the mallet portion 16 upwardly from the mallet bottom surface 24. The bottom surface 34 of the blade portion 30 is offset from the bottom surface 24 of the mallet portion 16. For the preferred embodiment herein described by way of example, the effect is to suspend the blade portion 30 above a playing surface 78 when the mallet portion 16 is on the surface such as a putting green, thus raising its center of gravity when striking the golf ball 38 and improving the rolling of the ball. As illustrated again with reference to FIGS. 5 and 8, a rounded bottom surface portion 80 for the mallet portion 16 is formed proximate the rear surface 40 of the blade portion 30 near its bottom surface 34 for encouraging a smooth and scuff free stroking of the ball 38.

As illustrated again with reference to FIG. 4, the mallet portion 16 includes a bore 84 therein for receiving the elongate shaft 14. The bore 84 is positioned within the heel portion 18 of the mallet portion 16. With the mallet portion 16 carrying a substantial mass of the putter head 12, which mass is uniformly distributed between a heel portion 18 and a toe portion 20 of the mallet portion, as earlier described, minimum torque is applied to the shaft 14 as the putter head 12 strikes the ball 38. The shaft 14 can thus act as a desirable pendulum arm while the putter head 12, in particular the front face 36 of the blade portion 30. The suspended blade portion 30 further has the effect of enhancing the feel and effect of the golf ball 38 striking the face 36 of the blade portion 30. Thus, by suspending the blade portion 30 as earlier described, and effectively extending the blade portion forward of the mallet portion 16 through the use of the cavity 64 as herein described, a desirable feel is provided. The present invention as herein described by way of example with preferred embodiments provides a putter 10 having the means for combined uniform contact with a golf ball 38 and uniform mass distributing of a golf ball interface, the front face 38, for striking the golf ball. Such a combination of mallet portion 16 and blade portion 30 also permits deviation from striking the ball 38 exactly along the ball striding axis 60, thus allowing slight imperfections in the putting stroke yet producing a desirable result.

Figure 9:
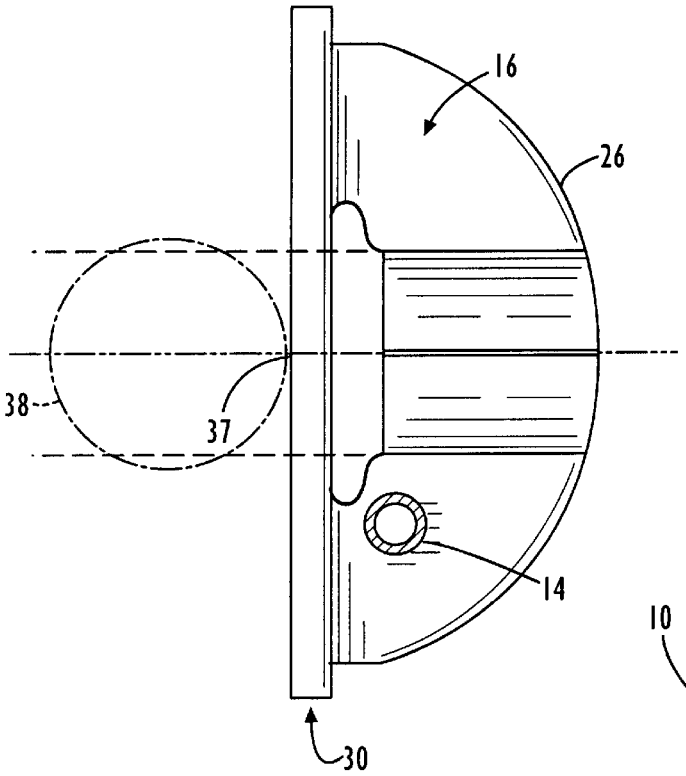
FIG. 9 is a top plan view of an alternate embodiment of the putter head of FIG. 3.
Figure 10:
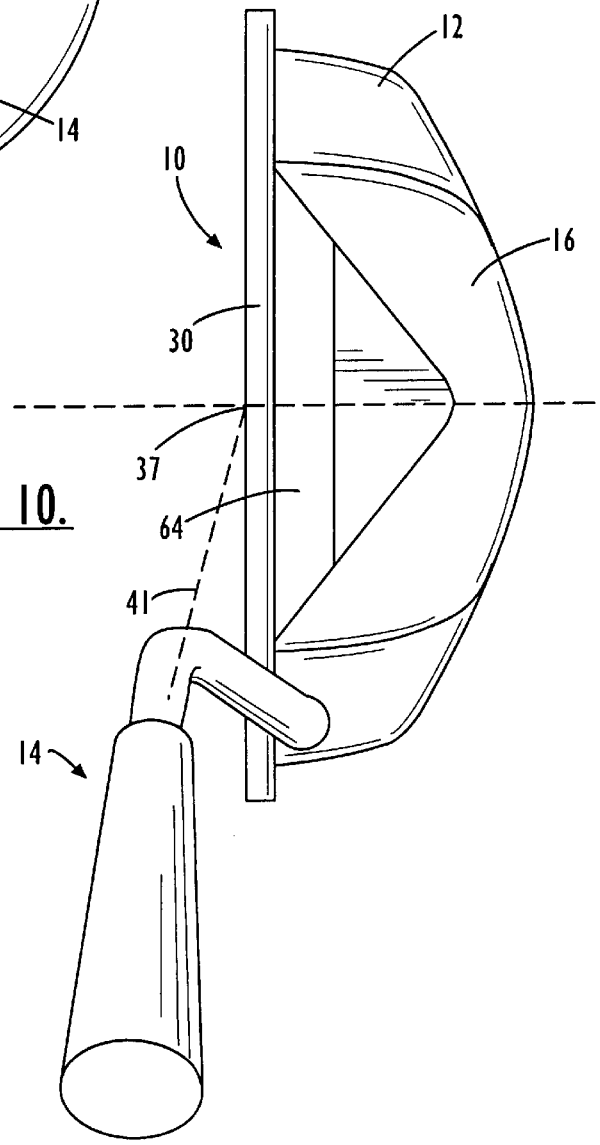
FIG. 10 is a top view of an alternate embodiment of a putter of the present invention.

As illustrated again with reference to FIG. 5, by way of example for a preferred embodiment of the present invention, the front face 36 includes a positive loft, approximately ¾ degree, angled for providing a slight lift to the ball trajectory and affecting a desirable roll of the ball 38 when struck. As illustrated again with reference to FIG. 4, a preferred embodiment of the present invention includes an arcuate rear surface 26 for the mallet portion 16, which surface is formed by multiple, generally planar surfaces. As illustrated with reference to FIG. 9, the rear surface 26 may have a generally cylindrical shape, or even a squared or planar shape as desired without deviating from the present invention, as is also true for the putter 10 illustrated with reference to FIG. 10.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A golf putter comprising:

a putter head comprising:

a mallet portion carrying a substantial mass of the puffer head uniformly distributed between heel and toe portions of the mallet portion, the mallet portion having a top surface, an opposing arcuate bottom surface, an arcuate rear surface, and a flat front surface; and a blade portion carried by the mallet portion, the blade portion having a bottom surface offset from the bottom surface of the mallet portion, a flat front face for striking a golf ball, and a rear surface generally parallel to the flat front face, the rear surface attached to the front surface of the mallet portion; and an elongate shaft extending upwardly from the mallet portion, the elongate shaft having a handle portion and an opposing head portion, the opposing head portion having a double bend spaced from the mallet portion for positioning the handle portion of the elongate shaft above the blade portion for providing face balancing to the putter.

2. The golf putter according to claim 1, further comprising alignment means for aligning the putter for striking the golf ball, the alignment means having a channel carried within the top surface of the mallet portion and longitudinally extending from the rear surface toward the front surface of the mallet portion, the channel forming opposing parallel elongate side wall portions transversely spaced for aligning the golf ball within imaginary lines extending forward from the opposing side wall portions through the front face, the opposing elongate side wall portions of the channel being perpendicular to the front face.

3. The golf putter according to claim 2, wherein the channel includes a contoured surface transversely extending between the elongate side wall portions, the channel further having a bottom most surface portion of the contoured surface lying along a ball striking axis extending longitudinally through the putter head.

4. The golf putter according to claim 3, wherein the bottom most surface portion of the channel includes an elongate groove extending longitudinally along the channel for forming a sight line along the ball striking axis of the putter head.

5. The golf putter according to claim 1, wherein the mallet portion includes an elongate cavity extending transversely across a central portion of the front surface of the mallet portion, the central portion of the front surface of the mallet portion and a central portion of the rear surface of the blade portion forming cavity walls, the elongate cavity extending from the mallet top surface to the mallet bottom surface.

6. The golf putter according to claim 5, wherein the cavity further extends into the mallet portion through the front surface thereof.

7. The golf putter according to claim 1, wherein the mallet portion comprises a rounded bottom surface portion proximate the rear surface of the blade portion.

8. The golf putter according to claim 1, wherein the bottom surface of the blade portion is suspended above the bottom surface of the mallet portion when the mallet portion rests on a playing surface for striking the golf ball.

9. The golf putter according to claim 1, wherein the mallet portion is integrally formed with the blade portion.

10. The golf putter according to claim 1, wherein the mallet portion includes a bore therein for receiving the elongate shaft, the bore positioned within the heel portion of the mallet portion.

11. The golf putter according to claim 1, wherein the blade portion includes a transverse width dimension greater than a transverse width dimension of the front surface of the mallet portion for extending the front face of the blade portion transversely outward of the front surface of the mallet portion.

12. A golf putter comprising:

a putter head comprising:

a mallet portion carrying a substantial mass of the putter head, the mallet portion having a top surface, an opposing bottom surface, a rear surface, and a front surface;

alignment means for aligning the puffer for striking the golf ball, the alignment means having a channel carried within the top surface of the mallet portion and longitudinally extending from the rear surface of the mallet portion toward the front surface of the mallet portion, the channel forming opposing parallel elongate side wall portions transversely spaced for aligning the golf ball within imaginary lines extending forward from the opposing side wall portions through the front face, the opposing elongate side wall portions of the channel being perpendicular to the front face; and a blade portion carried by the mallet portion, the blade portion having an elongate bottom surface, a flat front face for striking a golf ball, and a rear surface, the rear surface attached to the front surface of the mallet portion; and an elongate shaft extending upwardly from the putter head.

13. The golf putter according to claim 13, wherein the elongate shaft includes a handle portion and an opposing head portion extending upwardly from the mallet portion, the opposing head portion having a double bend spaced from the mallet portion for positioning the handle portion of the elongate shaft above the blade portion and for providing face balancing to the putter.

14. The golf putter according to claim 13, wherein the rear surface of the mallet portion includes an arcuate shape.

15. The golf putter according to claim 13, wherein the substantial mass of the mallet portion is generally distributed uniformly throughout the mallet portion.

16. The golf putter according to claim 13, wherein the channel includes a contoured surface transversely extending between the elongate side wall portions, the channel further having a bottom most surface portion of the contoured surface lying along a ball striking axis extending longitudinally through the putter head.

17. The golf putter according to claim 13, wherein the bottom most surface portion of the channel includes an elongate groove extending longitudinally along the channel for forming a sight line along the ball striking axis of the putter head.

18. The golf putter according to claim 13, wherein the mallet portion includes an elongate cavity extending transversely across a central portion of the front surface of the mallet portion, the central portion of the front surface of the mallet portion and a central portion of the rear surface of the blade portion forming cavity walls, the elongate cavity extending from the mallet top surface to the mallet bottom surface.

19. The golf putter according to claim 13, wherein the bottom surface of the blade portion is offset from the bottom surface of the mallet portion.

20. The golf putter according to claim 21, wherein the mallet portion comprises a rounded bottom surface portion proximate the rear surface of the blade portion.

21. The golf putter according to claim 13, wherein the bottom surface of the blade portion is suspended above the bottom surface of the mallet portion when the mallet portion rests on a playing surface for striking the golf ball.

22. The golf putter according to claim 23, wherein the mallet portion is integrally formed with the blade portion.

23. The golf putter according to claim 24, wherein the mallet portion includes a bore therein for receiving the elongate shaft, the bore positioned within the heel portion of the mallet portion.

24. The golf putter according to claim 13, wherein the blade portion includes a transverse width dimension greater than a transverse width dimension of the front surface of the mallet portion for extending the front face of the blade portion transversely outward of the front surface of the mallet portion.

25. A golf putter head:

a mallet portion carrying a substantial mass of the putter head uniformly distributed between heel and toe portions of the mallet portion, the mallet portion having a top surface, an opposing arcuate bottom surface, an arcuate rear surface, and a flat front surface; and a blade portion carried by the mallet portion, the blade portion having a bottom surface offset from the bottom surface of the mallet portion, a flat front face for striking a golf ball, and a rear surface generally parallel to the flat front face, the rear surface attached to the front surface of the mallet portion.

26. The golf putter head according to claim 27, wherein the mallet portion includes a bore within a heel portion for receiving an elongate shaft extending upwardly from the mallet portion, the elongate shaft having a handle portion and an opposing head portion, the opposing head portion having a double bend spaced from the mallet portion for positioning the handle portion of the elongate shaft above the blade portion.

27. The golf putter head according to claim 27, further comprising alignment means for aligning the putter for striking the golf ball, the alignment means having a channel carried within the top surface of the mallet portion and longitudinally extending from the rear surface toward the front surface of the mallet portion, the channel forming opposing parallel elongate side wall portions transversely spaced for aligning the golf ball within imaginary lines extending forward from the opposing side wall portions through the front face, the opposing elongate side wall portions of the channel being perpendicular to the front face.

28. The golf putter head according to claim 29, wherein the channel includes a contoured surface transversely extending between the elongate side wall portions, the channel further having a bottom most surface portion of the contoured surface lying along a ball striking axis extending longitudinally through the putter head.

29. The golf putter head according to claim 30, wherein the bottom most surface portion of the channel includes an elongate groove extending longitudinally along the channel for forming a sight line along the ball striking axis of the putter head.

30. The golf putter head according to claim 27, wherein the mallet portion includes an elongate cavity extending transversely across a central portion of the front surface of the mallet portion, the central portion of the front surface of the mallet portion and a central portion of the rear surface of the blade portion forming cavity walls, the elongate cavity extending from the mallet top surface to the mallet bottom surface.

31. The golf putter according to claim 32, wherein the cavity further extends into the mallet portion through the front surface thereof.

32. The golf putter head according to claim 27, wherein the mallet portion comprises a rounded bottom surface portion proximate the rear surface of the blade portion for forming an arcuate transition from the bottom surface of the mallet portion to the bottom surface of the blade portion.

33. The golf putter head according to claim 27, wherein the bottom surface of the blade portion is suspended above the bottom surface of the mallet portion when the mallet portion rests on a playing surface for striking the golf ball.

34. The golf putter head according to claim 27, wherein the mallet portion is integrally formed with the blade portion.

35. The golf putter according to claim 27, wherein the blade portion includes a transverse width dimension greater than a transverse width dimension of the front surface of the mallet portion for extending the front face of the blade portion transversely outward of the front surface of the mallet portion.

36. A golf putter head comprising:

a mallet portion carrying a substantial mass of the putter head, the mallet portion having a top surface, an opposing bottom surface, a rear surface, and a front surface;

alignment means for aligning the putter for striking the golf ball, the alignment means having a channel carried within the top surface of the mallet portion and longitudinally extending from the rear surface of the mallet portion toward the front surface of the mallet portion, the channel forming opposing parallel elongate side wall portions transversely spaced for aligning the golf ball within imaginary lines extending forward from the opposing side wall portions through the front face, the opposing elongate side wall portions of the channel being perpendicular to the front face; and a blade portion carried by the mallet portion, the blade portion having an elongate bottom surface, a flat front face for striking a golf ball, and a rear surface, the rear surface attached to the front surface of the mallet portion.

37. The golf putter head according to claim 39, wherein the mallet portion on includes a bore therein for receiving an elongate shaft.

38. The golf putter head according to claim 39, wherein the rear surface of the mallet portion includes an arcuate shape.

39. The golf putter head according to claim 39, wherein the substantial mass of the mallet portion is generally distributed uniformly throughout the mallet portion.

40. The golf putter head according to claim 39, wherein the channel includes a contoured surface transversely extending between the elongate side wall portions, the channel further having a bottom most surface portion of the contoured surface lying along a ball striking axis extending longitudinally through the putter head.

41. The golf putter head according to claim 39, wherein the bottom most surface portion of the channel includes an elongate groove extending longitudinally along the channel for forming a sight line along the ball striking axis of the putter head.

42. The golf putter head according to claim 39, wherein the mallet portion includes an elongate cavity extending transversely across a central portion of the front surface of the mallet portion, the central portion of the front surface of the mallet portion and a central portion of the rear surface of the blade portion forming cavity walls, the elongate cavity extending from the mallet top surface to the mallet bottom surface.

43. The golf putter head according to claim 39, wherein the bottom surface of the blade portion is offset from the bottom surface of the mallet portion.

44. The golf putter head according to claim 39, wherein the mallet portion comprises a rounded bottom surface portion proximate the rear surface of the blade portion.

45. The golf putter head according to claim 39, wherein the bottom surface of the blade portion is suspended above the bottom surface of the mallet portion when the mallet portion rests on a playing surface for striking the golf ball.

46. The golf putter head according to claim 39, wherein the mallet portion is integrally formed with the blade portion.

47. The golf putter head according to claim 39, wherein the blade portion includes a transverse width dimension greater than a transverse width dimension of the front surface of the mallet portion for extending the front face of the blade portion transversely outward of the front surface of the mallet portion.

* * * * *